US007717042B2

(12) United States Patent
Lloyd

(10) Patent No.: US 7,717,042 B2
(45) Date of Patent: May 18, 2010

(54) WIDE AREA DISPERSAL WARHEAD

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/030,455

(22) Filed: Jan. 6, 2005

(65) Prior Publication Data

US 2006/0112847 A1 Jun. 1, 2006

Related U.S. Application Data

(63) Continuation-in-part of application No. 10/998,457, filed on Nov. 29, 2004.

(51) Int. Cl.
*F42B 12/32* (2006.01)

(52) U.S. Cl. ..... 102/497; 102/489

(58) Field of Classification Search ..... 102/475, 102/476, 489, 494–497
See application file for complete search history.

(56) References Cited

U.S. PATENT DOCUMENTS 1,006,875 A * 10/1911 Puff ..... 102/494
1,198,035 A 9/1916 Huntington
1,229,421 A 6/1917 Downs
1,235,076 A 7/1917 Stanton
1,244,046 A 10/1917 Ffrench
1,300,333 A 4/1919 Berry
1,303,727 A 5/1919 Rice
1,305,967 A 6/1919 Hawks
2,296,980 A 9/1942 Carmichael
2,308,683 A 1/1943 Forbes
2,322,624 A 6/1943 Forbes
2,337,765 A 12/1943 Nahirney
2,360,696 A 10/1944 Long
2,411,862 A 12/1946 Arnold
2,413,008 A * 12/1946 Taglialatela ..... 102/389
2,457,817 A 1/1949 Harrell
2,925,965 A 2/1960 Pierce
2,972,950 A 2/1961 Welanetz
2,988,994 A 6/1961 Fleischer, Jr. et al.
3,092,026 A 6/1963 Williams et al.
3,263,612 A 8/1966 Throner, Jr.
3,332,348 A 7/1967 Myers et al.
3,464,356 A 9/1969 Wasserman et al.
3,474,731 A 10/1969 Thomanek (Continued)

FOREIGN PATENT DOCUMENTS

CH 649627 A * 5/1985

(Continued)

OTHER PUBLICATIONS

BGM-109 Tomahawk, FAS Military Analysis Network, Nov. 12, 2001 (8 pages).

(Continued)

*Primary Examiner*—Troy Chambers
(74) *Attorney, Agent, or Firm*—Iandiorio Teska & Coleman

(57) ABSTRACT

A wide area dispersal warhead including a housing defining a cavity, an explosive charge in the housing, and a large plurality of individual munitions in the cavity of the housing about the explosive charge. The explosive charge is configured to deploy the munitions upon detonation into a hemispherical dome shaped pattern.

19 Claims, 8 Drawing Sheets

U.S. PATENT DOCUMENTS

| | | | | | |
|---|---|---|---|---|---|
| 3,489,088 | A | * | 1/1970 | von Ballmoos et al. | 102/496 |
| 3,565,009 | A | | 2/1971 | Allred et al. | |
| 3,656,433 | A | | 4/1972 | Thrailkill et al. | |
| 3,665,009 | A | | 5/1972 | Dickinson, Jr. | |
| 3,667,390 | A | | 6/1972 | Medin et al. | |
| 3,712,233 | A | | 1/1973 | Drake et al. | |
| 3,749,615 | A | | 7/1973 | Dorsey, Jr. et al. | |
| 3,757,694 | A | | 9/1973 | Talley et al. | |
| 3,771,455 | A | | 11/1973 | Haas | |
| 3,796,159 | A | | 3/1974 | Conger | |
| 3,797,359 | A | | 3/1974 | Mawhinney et al. | |
| 3,818,833 | A | | 6/1974 | Throner, Jr. | |
| 3,846,878 | A | | 11/1974 | Monson et al. | |
| 3,851,590 | A | | 12/1974 | LaCosta | |
| 3,861,314 | A | | 1/1975 | Barr | |
| 3,877,376 | A | | 4/1975 | Kupelian | |
| 3,880,081 | A | | 4/1975 | Riffin et al. | |
| 3,902,424 | A | | 9/1975 | Dietsch et al. | |
| 3,903,804 | A | | 9/1975 | Luttrell et al. | |
| 3,906,860 | A | * | 9/1975 | Johns | 102/476 |
| 3,915,092 | A | | 10/1975 | Monson et al. | |
| 3,941,059 | A | | 3/1976 | Cobb | |
| 3,949,674 | A | | 4/1976 | Talley | |
| 3,954,060 | A | | 5/1976 | Haag et al. | |
| 3,969,674 | A | | 7/1976 | Tracey | |
| 3,977,330 | A | | 8/1976 | Held | |
| 4,015,527 | A | | 4/1977 | Evans | |
| 4,026,213 | A | | 5/1977 | Kempton | |
| 4,036,140 | A | | 7/1977 | Korr et al. | |
| 4,068,590 | A | | 1/1978 | Pearson | |
| 4,089,267 | A | | 5/1978 | Mescall et al. | |
| 4,106,410 | A | | 8/1978 | Borcher et al. | |
| 4,129,081 | A | | 12/1978 | Bedall et al. | |
| 4,147,108 | A | * | 4/1979 | Gore et al. | 102/494 |
| 4,172,407 | A | | 10/1979 | Wentink | |
| 4,210,082 | A | | 7/1980 | Brothers | |
| 4,211,169 | A | * | 7/1980 | Brothers | 102/494 |
| 4,231,293 | A | | 11/1980 | Dahn et al. | |
| 4,289,073 | A | | 9/1981 | Romer et al. | |
| 4,312,274 | A | | 1/1982 | Zernow | |
| 4,327,643 | A | * | 5/1982 | Lasheras Barrios | 102/493 |
| 4,353,305 | A | | 10/1982 | Moreau et al. | |
| 4,372,216 | A | | 2/1983 | Pinson et al. | |
| 4,376,901 | A | | 3/1983 | Pettibone et al. | |
| 4,430,941 | A | * | 2/1984 | Raech et al. | 102/496 |
| 4,455,943 | A | | 6/1984 | Pinson | |
| 4,495,869 | A | | 1/1985 | Bisping | |
| 4,497,253 | A | | 2/1985 | Sabranski | |
| 4,516,501 | A | | 5/1985 | Held et al. | |
| 4,522,356 | A | | 6/1985 | Lair et al. | |
| 4,524,696 | A | * | 6/1985 | Altenau et al. | 102/491 |
| 4,524,697 | A | | 6/1985 | Bocker et al. | |
| 4,538,519 | A | | 9/1985 | Witt et al. | |
| 4,638,737 | A | | 1/1987 | McIngvale | |
| 4,648,323 | A | | 3/1987 | Lawther | |
| 4,655,139 | A | * | 4/1987 | Wilhelm | 102/494 |
| 4,658,727 | A | | 4/1987 | Wilhelm et al. | |
| 4,664,035 | A | | 5/1987 | Osofsky | |
| 4,676,167 | A | | 6/1987 | Huber, Jr. et al. | |
| 4,686,904 | A | | 8/1987 | Stafford | |
| 4,724,769 | A | | 2/1988 | Luther et al. | |
| 4,729,321 | A | | 3/1988 | Stafford | |
| 4,745,864 | A | | 5/1988 | Craddock | |
| 4,750,423 | A | | 6/1988 | Nagabhushan | |
| 4,770,101 | A | | 9/1988 | Robertson et al. | |
| 4,777,882 | A | | 10/1988 | Dieval | |
| 4,848,239 | A | | 7/1989 | Wilhelm | |
| 4,872,409 | A | | 10/1989 | Becker et al. | |
| 4,882,996 | A | * | 11/1989 | Bock et al. | 102/496 |
| 4,907,512 | A | | 3/1990 | Arene | |
| 4,922,826 | A | | 5/1990 | Busch et al. | |
| 4,922,827 | A | | 5/1990 | Remo | |
| 4,942,820 | A | | 7/1990 | Sawruk | |
| 4,947,754 | A | * | 8/1990 | LaRocca | 102/489 |
| 4,949,644 | A | | 8/1990 | Brown | |
| 4,957,046 | A | | 9/1990 | Puttock | |
| 4,982,668 | A | | 1/1991 | Bender et al. | |
| 4,995,573 | A | | 2/1991 | Wallow | |
| 4,996,923 | A | | 3/1991 | Theising | |
| 5,040,464 | A | | 8/1991 | Pearson | |
| 5,067,411 | A | | 11/1991 | Ball | |
| 5,087,415 | A | | 2/1992 | Hemphill et al. | |
| H1047 | H | | 5/1992 | Henderson et al. | |
| H1048 | H | | 5/1992 | Wilson et al. | |
| 5,111,748 | A | | 5/1992 | Thurner et al. | |
| 5,157,225 | A | | 10/1992 | Adams et al. | |
| 5,182,418 | A | | 1/1993 | Talley | |
| 5,191,169 | A | | 3/1993 | Hu | |
| 5,223,667 | A | | 6/1993 | Anderson | |
| 5,229,542 | A | | 7/1993 | Bryan et al. | |
| 5,243,916 | A | | 9/1993 | Freche et al. | |
| 5,293,822 | A | | 3/1994 | Peddie | |
| 5,313,890 | A | | 5/1994 | Cuadros | |
| 5,370,053 | A | | 12/1994 | Williams et al. | |
| 5,431,106 | A | | 7/1995 | Dunn et al. | |
| 5,524,524 | A | | 6/1996 | Richards et al. | |
| 5,535,679 | A | | 7/1996 | Craddock | |
| 5,542,354 | A | | 8/1996 | Sigler | |
| 5,544,589 | A | | 8/1996 | Held | |
| 5,565,647 | A | | 10/1996 | Kerdraon et al. | |
| 5,577,431 | A | | 11/1996 | Küsters | |
| 5,578,783 | A | | 11/1996 | Brandeis | |
| 5,583,311 | A | | 12/1996 | Rieger | |
| 5,622,335 | A | | 4/1997 | Trouillot et al. | |
| D380,784 | S | | 7/1997 | Smith | |
| 5,668,346 | A | | 9/1997 | Kunz et al. | |
| 5,670,735 | A | | 9/1997 | Ortmann et al. | |
| 5,691,502 | A | | 11/1997 | Craddock et al. | |
| 5,763,819 | A | | 6/1998 | Huffman | |
| 5,796,031 | A | | 8/1998 | Sigler | |
| 5,821,449 | A | | 10/1998 | Langsjoen et al. | |
| 5,823,469 | A | | 10/1998 | Arkhangelsky et al. | |
| 5,929,370 | A | | 7/1999 | Brown et al. | |
| 5,936,191 | A | | 8/1999 | Bisping et al. | |
| 6,010,580 | A | | 1/2000 | Dandliker et al. | |
| 6,035,501 | A | | 3/2000 | Bisping et al. | |
| 6,044,765 | A | | 4/2000 | Regebro | |
| 6,186,070 | B1 | | 2/2001 | Fong et al. | |
| 6,223,658 | B1 | | 5/2001 | Rosa et al. | |
| 6,230,630 | B1 | | 5/2001 | Gibson et al. | |
| 6,270,549 | B1 | | 8/2001 | Amick | |
| 6,276,277 | B1 | | 8/2001 | Schmacker | |
| 6,279,478 | B1 | | 8/2001 | Ringer et al. | |
| 6,279,482 | B1 | * | 8/2001 | Smith et al. | 102/374 |
| 6,367,388 | B1 | | 4/2002 | Billings | |
| 6,484,642 | B1 | | 11/2002 | Kuhns et al. | |
| 6,502,515 | B2 | | 1/2003 | Burckhardt et al. | |
| 6,598,534 | B2 | * | 7/2003 | Lloyd et al. | 102/494 |
| 6,619,210 | B1 | | 9/2003 | Spivak et al. | |
| 6,621,059 | B1 | | 9/2003 | Harris et al. | |
| 6,622,632 | B1 | | 9/2003 | Spivak | |
| 6,666,145 | B1 | | 12/2003 | Nardone et al. | |
| 6,672,220 | B2 | | 1/2004 | Brooks et al. | |
| 6,789,484 | B2 | | 9/2004 | Kellner | |
| 6,899,034 | B1 | | 5/2005 | Glover et al. | |
| 6,973,878 | B2 | | 12/2005 | Lloyd et al. | |
| 2002/0166475 | A1 | | 11/2002 | Brooks et al. | |
| 2003/0019386 | A1 | | 1/2003 | Lloyd et al. | |
| 2003/0029347 | A1 | | 2/2003 | Lloyd | |
| 2003/0177934 | A1 | | 9/2003 | Spivak et al. | |
| 2004/0011238 | A1 | | 1/2004 | Ronn et al. | |
| 2004/0055498 | A1 | | 3/2004 | Lloyd | |
| 2004/0055500 | A1 | | 3/2004 | Lloyd | |
| 2004/0069176 | A1 | | 4/2004 | Kellner | |

| | | | |
|---|---|---|---|
| 2004/0129162 | A1 | 7/2004 | Lloyd |
| 2004/0200380 | A1 | 10/2004 | Lloyd |
| 2005/0016372 | A1 | 1/2005 | Klivert |
| 2005/0066848 | A1 | 3/2005 | Muskat et al. |

FOREIGN PATENT DOCUMENTS

| | | | |
|---|---|---|---|
| DE | 3735426 | | 5/1889 |
| DE | 2206403 | A1 | 8/1973 |
| DE | 3327043 | A1 | 2/1985 |
| DE | 3340620 | A1 * | 5/1985 |
| DE | 3722420 | | 1/1989 |
| DE | 3735426 | | 5/1989 |
| DE | 3830527 | A1 | 3/1990 |
| DE | 3834367 | | 4/1990 |
| DE | 3934042 | A1 | 4/1991 |
| EP | 63995 | | 11/1982 |
| EP | 108741 | | 5/1984 |
| EP | 270 401 | A1 | 6/1988 |
| EP | 0655603 | A | 5/1995 |
| EP | 872705 | | 10/1998 |
| EP | 902250 | | 3/1999 |
| FR | 2678723 | A1 | 1/1993 |
| FR | 2695467 | | 3/1994 |
| GB | 550001 | | 12/1942 |
| GB | 2236581 | | 4/1991 |
| JP | 107825 | | 9/1934 |
| JP | 64-46596 | | 2/1989 |
| JP | 1-296100 | | 11/1989 |
| JP | 5-8295 | | 5/1993 |
| JP | 06074698 | | 3/1994 |
| JP | 6317400 | | 11/1994 |
| JP | 11-337299 | | 12/1999 |
| JP | 2002-174500 | | 6/2002 |
| WO | WO 97/27447 | | 7/1997 |
| WO | WO 9930966 | | 6/1999 |

OTHER PUBLICATIONS

Cruise Missile, Wikipedia, the free encyclopedia, date unknown (4 pages).

U.S. Appl. No. 10/384,804, filed Mar. 10, 2003, Lloyd.

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99-197.

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311-406.

FAS Military Analysis Network (http://www.fas.org/man/dod-101/sys/land/m546.htm): M546 APERS-T 105-mm, Jan. 21, 1999.

FAS Military Analysis Network (http://www.fas.org/man/dod-101/sys/land/bullets2.htm): Big Bullets for Beginners, Feb. 6, 2000.

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193-251.

Richard M. Lloyd, "Aligned Rod Lethality Enhanced Concept for Kill Vehicles", 10th AIAA/BMDD Technology Conf., Jul. 23-26, Williamsburg, Virginia, 2001, pp. 1-12.

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 2, pp. 19-77.

U.S. Appl. No. 10/301,302, filed Nov. 21, 2002, Lloyd.

U.S. Appl. No. 10/301,420, filed Nov. 21, 2002, Lloyd.

U.S. Appl. No. 10/685,242, filed Oct. 14, 2003, Lloyd.

U.S. Appl. No. 10/698,500, filed Oct. 31, 2003, Lloyd.

U.S. Appl. No. 10/924,104, filed Aug. 23, 2004, Lloyd.

U.S. Appl. No. 10/960,842, filed Oct. 7, 2004, Lloyd.

U.S. Appl. No. 10/998,457, filed Nov. 29, 2004, Lloyd.

U.S. Appl. No. 10/938,355, filed Sep. 10, 2004, Lloyd.

Richard M. Lloyd. "Aligned Rod Lethality Enhancement Concept for Kill Vehicles," AIAA/BMDD Technology Conf., Jun. 5, Maastricht, Netherlands, 2001:pp. 1-12.

* cited by examiner

WIDE AREA DISPERSAL WARHEAD

RELATED APPLICATIONS

This application is a continuation-in-part application of application Ser. No. 10/998,457 filed Nov. 29, 2004.

FIELD OF THE INVENTION

The subject invention relates to a warhead designed to simultaneously address multiple potential or actual threats.

BACKGROUND OF THE INVENTION

There are several scenarios where multiple potential or actual threats in a given volume of space are to be targeted. Conventional hit-to-kill and other missiles and warheads cannot typically be used to address multiple threats or targets in a given volume of space. Background information regarding hit-to-kill and other weapons is disclosed in textbooks by the inventor hereof: Chapters 2 and 5 of "Conventional Warhead Systems Physics and Engineering Design" (1998) and Chapters 3 and 6 of "Physics of Direct Hit and Near Miss Warhead Technology" (2001), incorporated herein by this reference.

SUMMARY OF THE INVENTION

It is therefore an object of this invention to provide a warhead designed to address multiple potential or actual threats simultaneously.

It is a further object of this invention to provide such a warhead which can be used in conjunction with a conventional kill vehicle wherein the warhead is deployed first to address multiple potential threats and the kill vehicle is deployed second to target actual threats.

The subject invention results from the realization that by packaging a large number of small munitions in a housing and designing an internal explosive charge to have a conical shape, the munitions are deployed into a hemispherical dome shaped pattern to more comprehensively address multiple potential or actual threats.

The subject invention, however, in other embodiments, need not achieve all these objectives and the claims hereof should not be limited to structures or methods capable of achieving these objectives.

This subject invention features a warhead comprising a housing defining a cavity, an explosive charge in the housing, and a large plurality of individual munitions in the cavity of the housing about the explosive charge. The explosive charge is configured to deploy the munitions upon detonation into a hemispherical dome shaped pattern.

Typically, the warhead housing includes a cylindrical body with first (base) and second (nose) end plates attached to the ends thereof. The nose end plate is preferably dome shaped. The preferred explosive charge is conical in shape tapering from a larger first end at the base to a smaller second end at the nose. It is also preferred to include a buffer material such as foam about the explosive charge.

In one example, the housing is toroid in shape. The munitions can be made from materials including glass, metal, tungsten carbide, a phenolic material, and explosive materials and typically there are 1,000,000 or more small spherical munitions in the housing. The explosive charge may be an insensitive explosive. The housing typically has a wall thickness of less than 2 mils.

In one example, the munitions include a munition core and a plurality of particles adhered to an external surface of the munition core designed to release from the munition core upon impact of the munition with a target. The munition core may be made of a dense material such as a tungsten carbide composition. The particles can be micro particle in size and can be made of a brittle material such as glass. Typically, the particles are attached to the munition core with an adhesive.

A warhead in accordance with the subject invention includes a housing defining a cavity, an explosive charge in the housing, and a plurality of individual munitions in the cavity of the housing about the explosive charge. The munitions include a munition core and a plurality of particles attached to an external surface of the munition core designed to release from the munition core upon impact of the munition with a target. One example of a warhead in accordance with the subject invention includes a housing defining a cavity and a nose and a base of the warhead, a large plurality of individual munitions in the cavity of the housing, and an explosive charge in the housing having a conical shape tapering from a smaller first end proximate the nose of the housing to a larger second end proximate the base of the housing to deploy the munitions upon detonation into a hemispherical dome shaped pattern.

A warhead in accordance with the subject invention includes a housing having a longitudinal axis, an explosive charge in the housing extending along the longitudinal axis thereof and having a conical shape, and a large plurality of individual munitions in the housing about the explosive charge.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
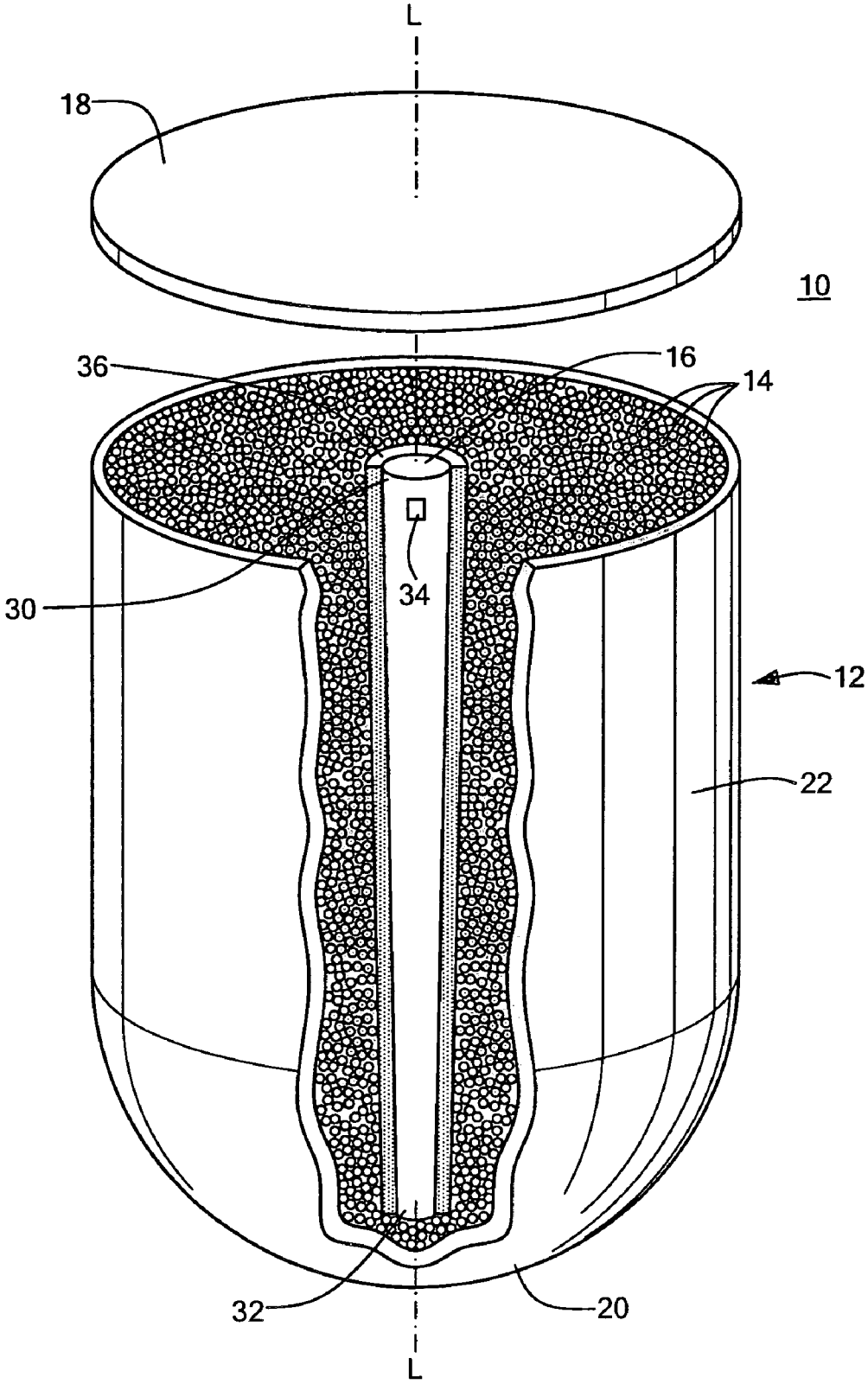
FIG. 1 is a schematic three-dimensional exploded partially cut-away front view of one embodiment of a warhead in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
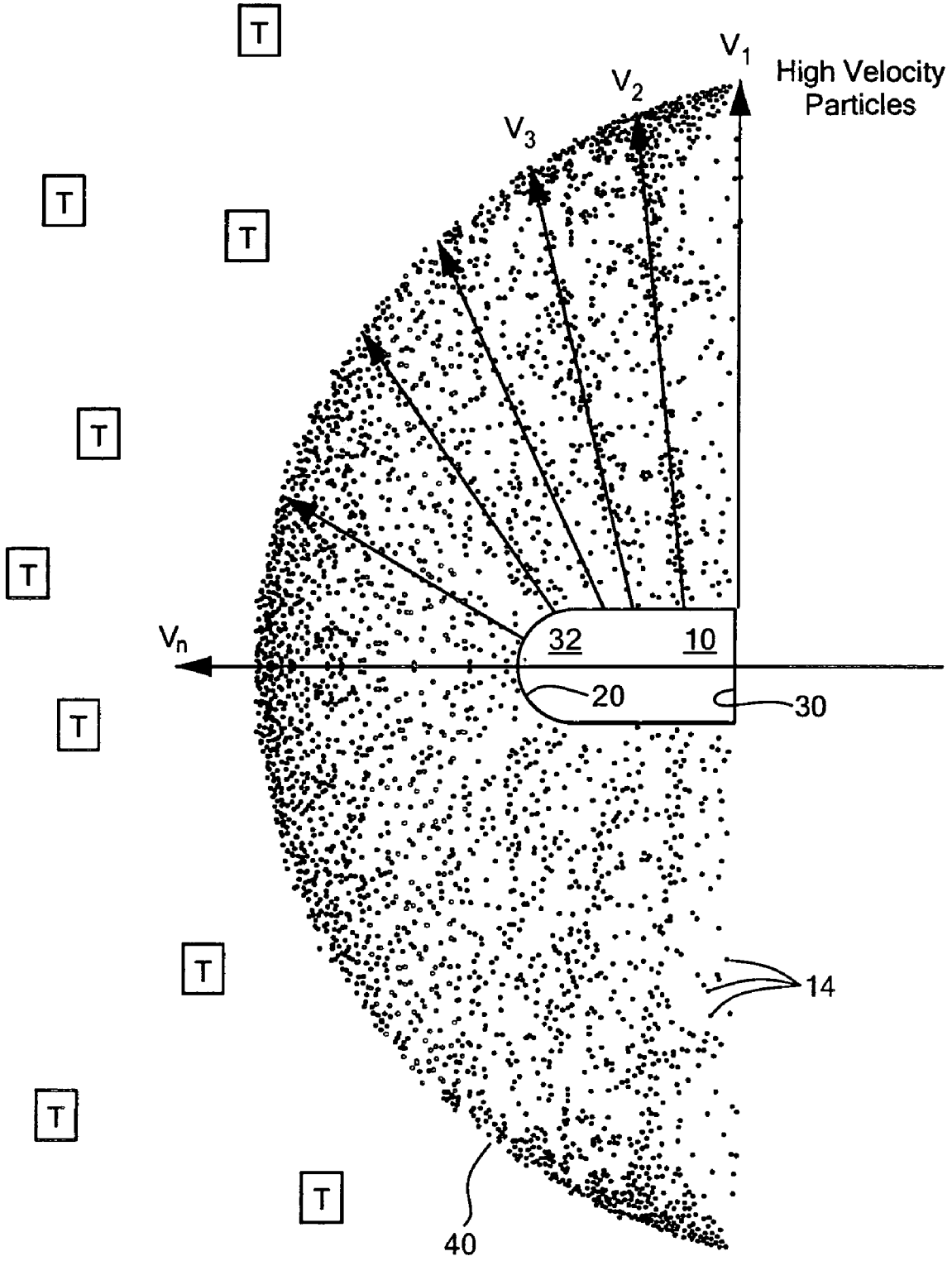
FIG. 2 is a side view showing the munition pattern created in a volume of space when the warhead shown in FIG. 1 is deployed.

Warhead 10, FIG. 1 includes housing 12 defining a cavity therein filled with a large plurality of individual munitions 14 about lengthy centrally located explosive charge 16. Explosive charge 16 is configured to deploy the munitions upon detonation into a hemispherical dome-shape pattern as shown in FIG. 2 to address multiple potential or actual targets T.

In one example, cylindrical housing 12 is 3-5 feet long, 3 feet in diameter and has first 18 and second 20 end plates. First end plate 18 constitutes the base of warhead 10 and is typically secured to housing body 22 after munitions 14 and explosive charge 16 are disposed therein. Second end plate 20 may be integral with body 22, is typically dome shaped, and constitutes the nose of the warhead. Thin (e.g., 1 mil) aluminum may be used for housing 12 rendering it expendable upon detonation of explosive charge 16.

Munitions 14 may be small 0.15" diameter spherical particles made of brittle material such as tungsten carbide, glass, or a phenolic material or they may also be made of metal or even explosive materials. Typically, there are between 1-5 million such munition particles disposed in housing 12. In another embodiment, the munitions are composite in design as discussed infra.

Explosive charge 16 may be an insensitive explosive such as PBXN109. The preferred explosive charge is conical in shape having a ½" diameter proximate base 30 and a ¼" diameter proximate nose 32. In this way, there is more explosive material at base end 30 than at nose end 32 creating a differential velocity of the particles along the longitudinal axis L of the warhead. In one example, explosive charge 16 is 3 feet long. Detonator 34 is typically a safe and arm initiation device. Foam buffer liner 36 may be disposed about explosive charge 16 to mitigate shock when explosive charge 16 is detonated by detonator 34. Foam buffer 36 may be conical in shape to conform to conical shaped explosive charge 16.

Warhead 10, FIG. 2 is carried by a carrier vehicle such as a missile or other rocket powered vehicle into a position in space in front of multiple potential targets T, FIG. 2. The conical shaped centrally disposed explosive charge, when detonated, creates a differential velocity between the munitions as shown in FIG. 2 so that the munitions proximate base 30 are deployed at a higher rate as shown in FIG. 2 than the munitions proximate nose 32. Conical shaped explosive charge 16, FIG. 1 thus creates a hemispherical dome shaped pattern 40, FIG. 2 of munitions 20 feet in radius or greater to address targets T when warhead 10 is deployed to a position in space in front of the trajectory path of a volume of targets as shown in FIG. 2. The spray pattern shown in FIG. 2 can spread thousands of feet generating multiple hits on targets T. When brittle material such as glass is used for munitions 14, they shatter upon impact with a target and break up into smaller particles which embed themselves.

Figure 3:
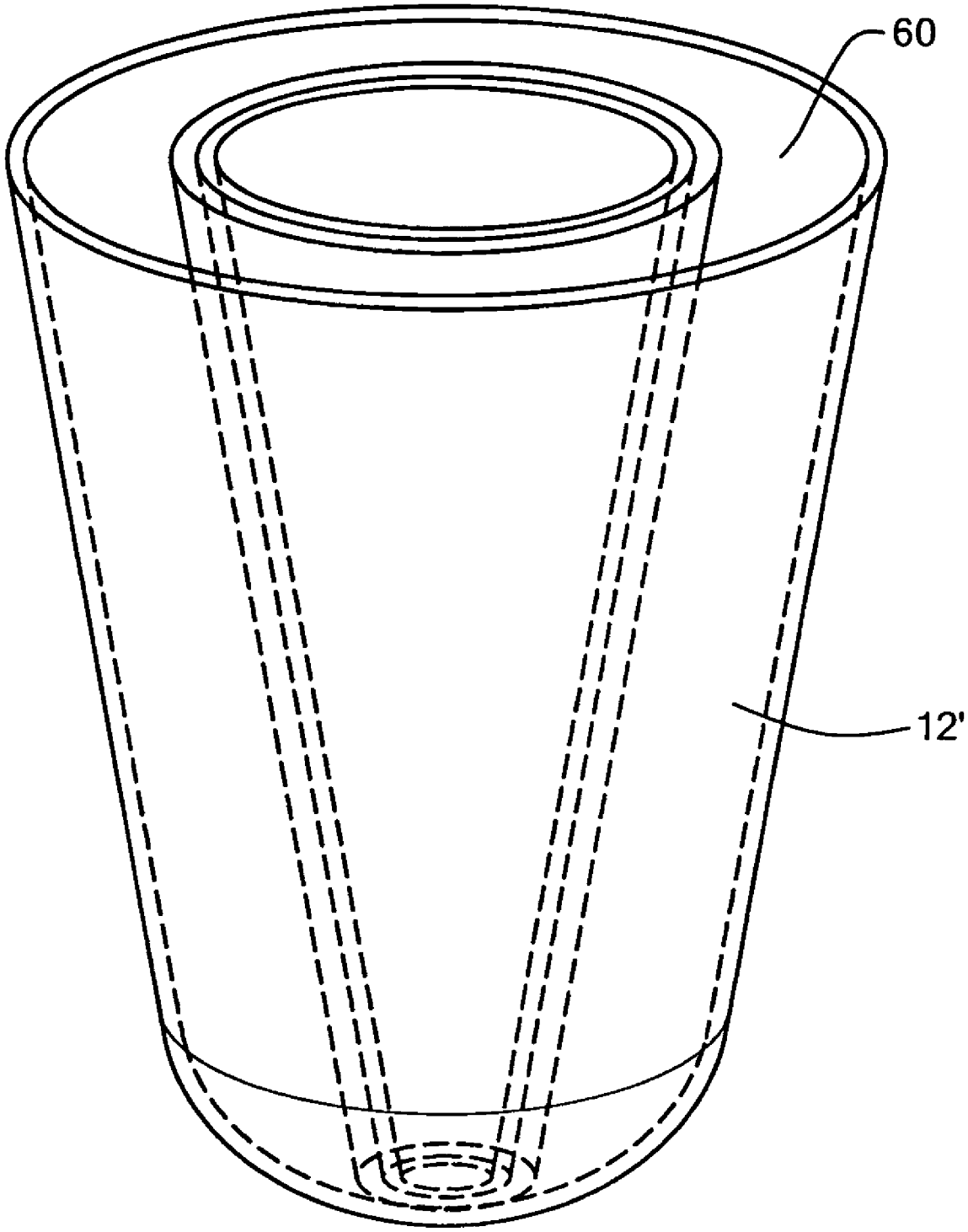
FIG. 3 is a three-dimensional partial schematic front view of another embodiment of a warhead housing in accordance with the subject invention.
Figure 4:
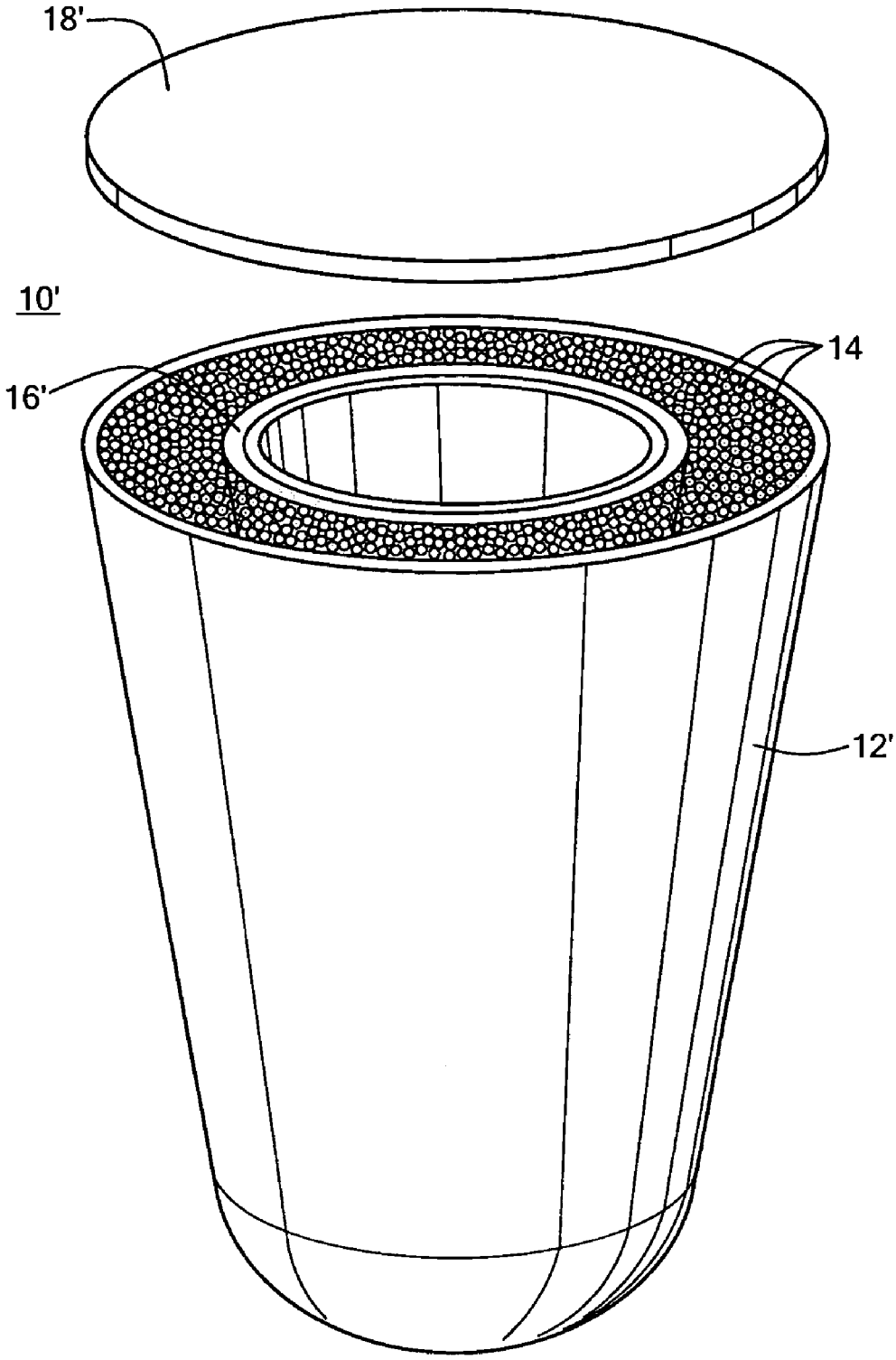
FIG. 4 is a schematic three-dimensional exploded front view of another embodiment of a warhead in accordance with the subject invention including the toroid shaped housing shown in FIG. 3.
Figure 5:
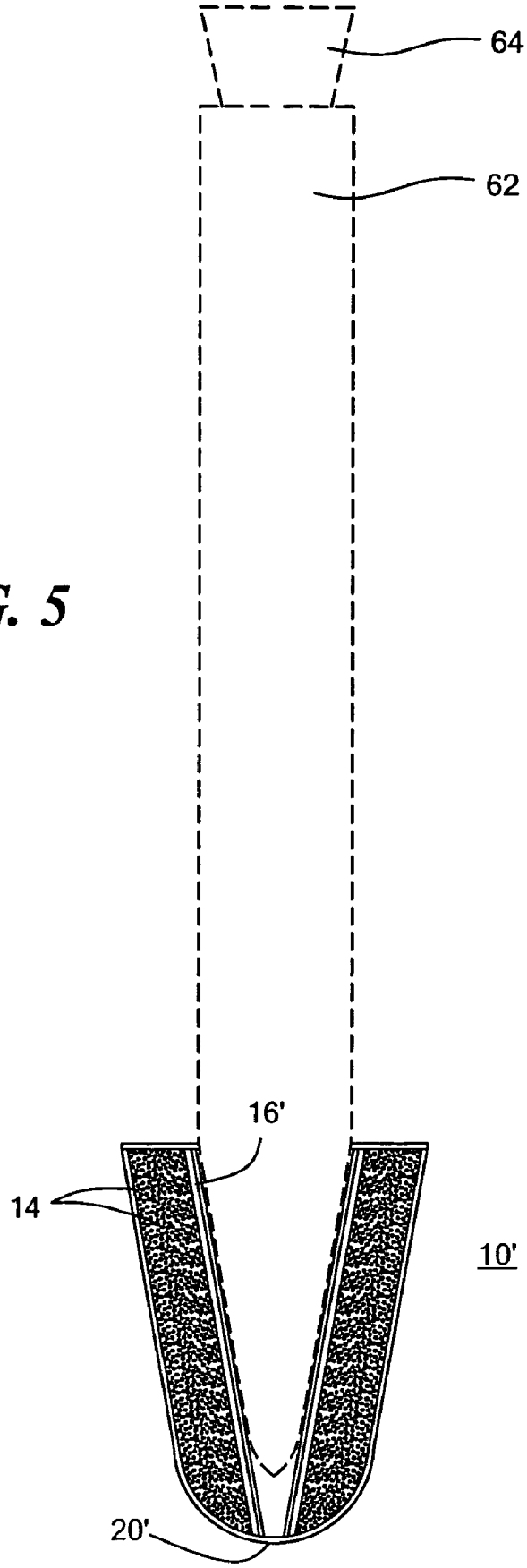
FIG. 5 is a schematic cross-sectional view showing the toroid shape warhead of FIG. 4 being carried by a traditional rocket powered vehicle.

Alternative housing 12', FIG. 3 is toroidal in shape as shown and includes cavity 60 which is filled with munitions 14 as shown in FIGS. 4-5. Toroid shaped explosive charge 16' in this embodiment is also conical in shape due to the conical shape of cavity 60, FIG. 3. In this way, warhead 10' can be carried by vehicle 62, FIG. 5 with rocket motor 64. A foam buffer material (not shown) may be incorporated in this design about explosive charge 16' as well to generate an impedance mismatch so the munitions do not shatter upon detonation of explosive charge 16'.

Figure 6:
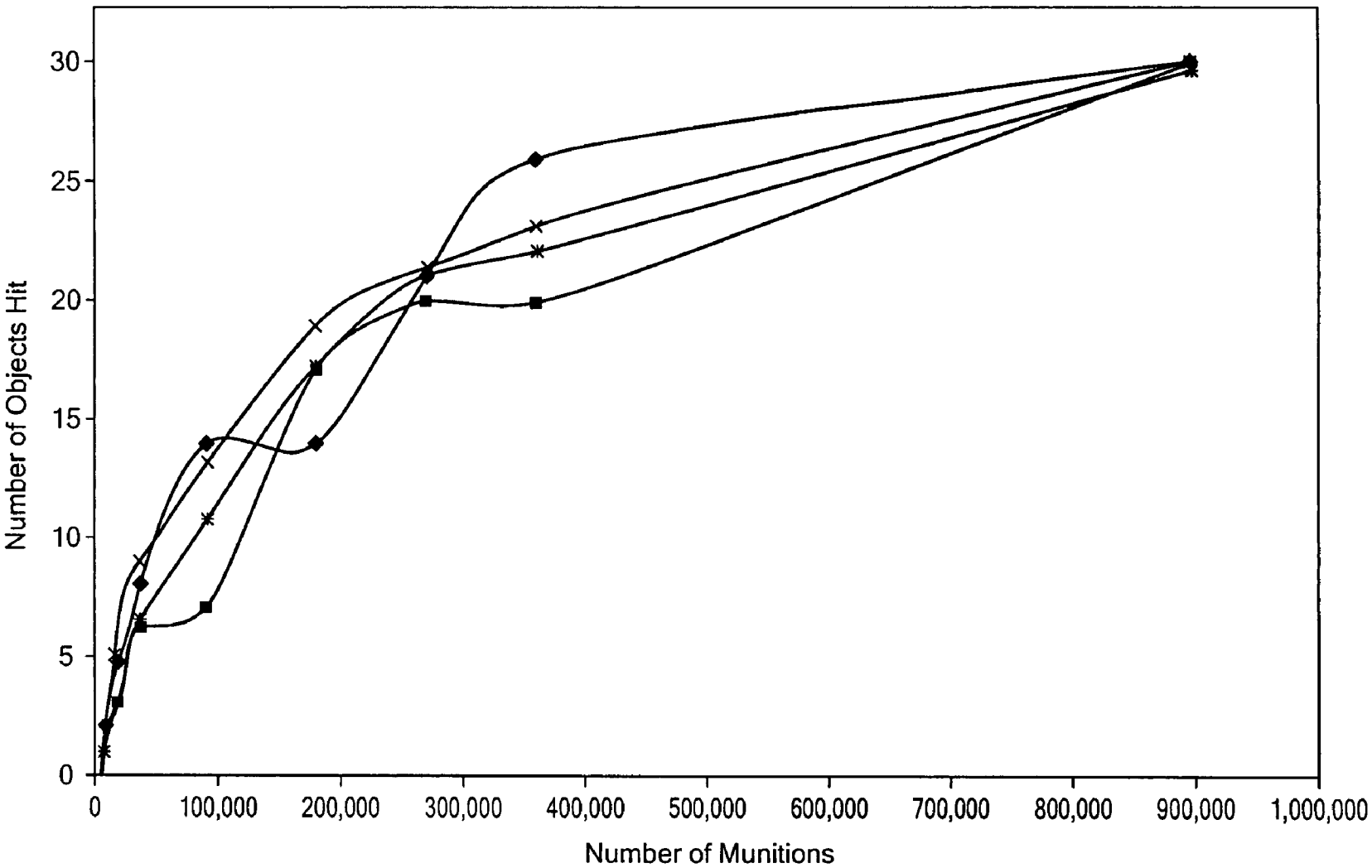
FIG. 6 is a graph showing the number of munitions as a function of the number of objects hit for a computer stimulation of three test cases involving the warhead shown in FIG. 1 assuming a large pattern radius.

FIG. 6 shows that in computer simulation, if approximately 1 million munitions are present in warhead 10, FIG. 1, at least one munition will strike each of 30 targets in a large radius.

Figure 7:
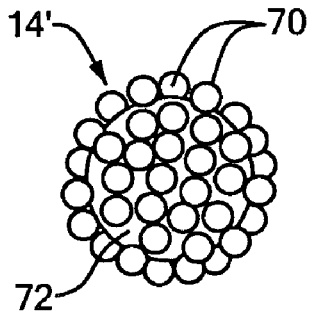
FIG. 7 is a schematic three-dimensional view showing one example of a munition in accordance with the subject invention.
Figure 8:
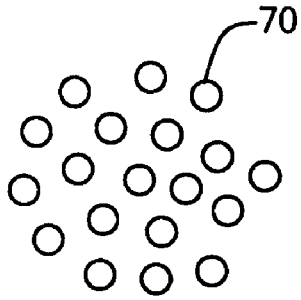
FIG. 8 is a schematic conceptual view showing the individual particles associated with the munition shown in FIG. 7.

In one embodiment, munitions 14 in housing 12, FIG. 1 or 12', FIGS. 2-5 are composite in configuration and are configured as shown for munition 14', FIG. 7. Small particles 70, FIG. 8 in accordance with the subject invention are glued or otherwise adhered to the external surface of munition core 72, FIG. 9 resulting in novel munition 14', FIG. 7. Particles 70 may be micro particle in size 400 microns in diameter, for example, and munition core 72 may be 1.25 inches in diameter. But, munition core 72 may be of various sizes and spherical in shape or any other shape. The same is true for particles 70: they may be spherical in shape but they also could be other shapes or random shapes or even flakes.

In accordance with the subject invention, the core 72 carries the many smaller particles to enhance the particle density upon impact. The smaller momentum particles 70 are typically epoxied on core 72 and fracture off during impact of the core with a target. Such a munition can be used for soft targets because the core has the overall mass to penetrate and provide a hole for the smaller particles to go through. The smaller particles then create a dense spray pattern upon release from the core.

Figure 10A:
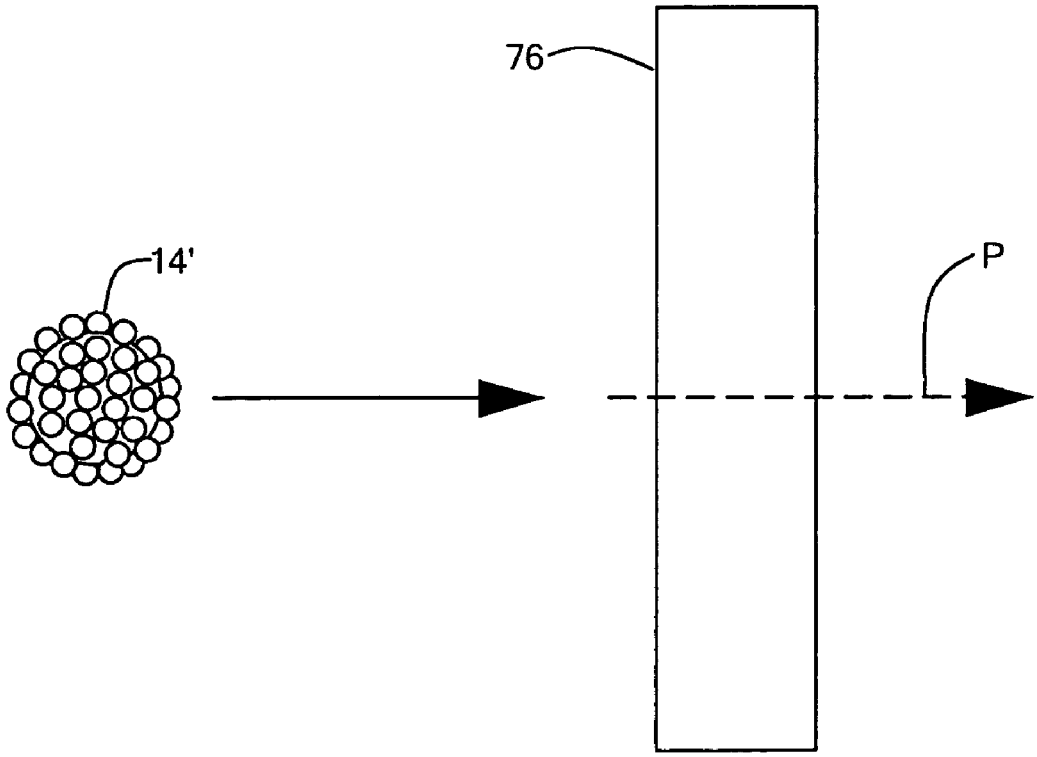
FIGS. 10A-10D are highly schematic side views showing the deployment of the munition shown in FIG. 7 at a single target.
Figure 10D:
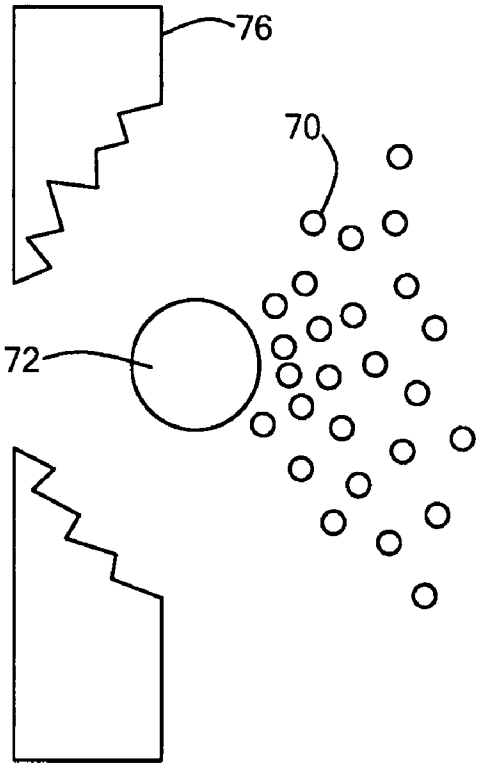
Figure 10C:
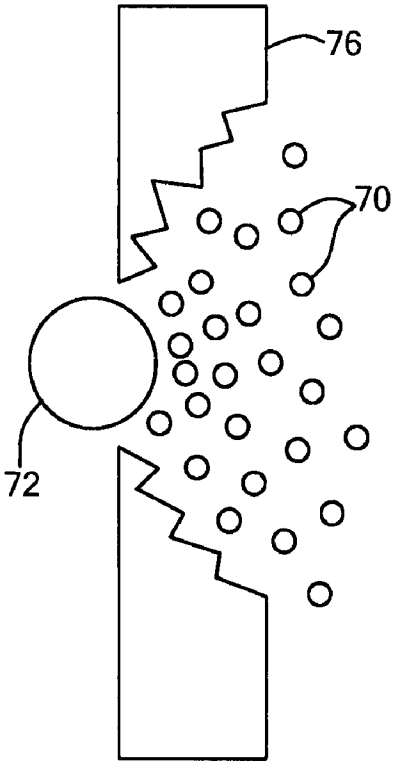
Figure 10B:
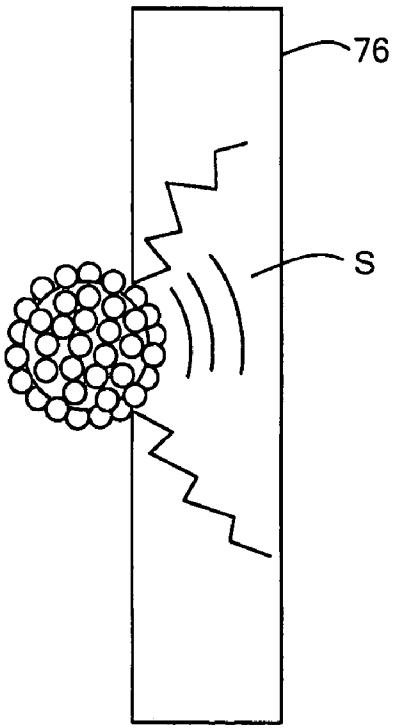

Munition 14', FIG. 10A is shown propelled to impact target 76 along path P. When munition 14' impacts target 76, FIG. 10B, the particles 70 break off munition core 72 as shown in FIG. 10C and create an exit opening generally larger than the entrance opening as shown in FIG. 10D.

The munition of the subject invention can also be used to destroy items or structure internal to target 76 but not necessarily directly in the direct path P, FIG. 10A of munition 14'. Unintended collateral damage which can occur in the case where munitions include explosives is minimized in accordance with the subject invention. For example, the munition core can be made of a dense material such as a tungsten carbide composition and the particles are made of a more brittle material such as glass. An adhesive such as an epoxy may be used to adhere the particles to the munition core. The final selection of the particles or the munition is determined by the kill requirements. The requirements are based on target thickness, impact velocity and target vulnerability.

Figure 9:
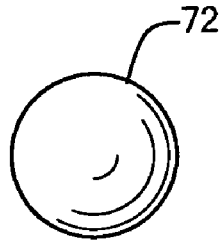
FIG. 9 is a schematic conceptual view of one embodiment of a munition core for the munition shown in FIG. 7.

In one embodiment, munition core 72, FIGS. 7 and 9 was a tungsten carbide composition 0.15" in diameter. Particles 70 constituted 500-1,000 glass spheres each 400 microns in size attached to core 72 by an epoxy. The shockwave S produced when core 72 strikes a target causes particles 10 to dislodge from core 72 and form the spray pattern shown in FIGS. 10C-10D.

The size, shape and composition of the core, however, as well as the size, shape, number, and composition of the particles will vary depending on the specific implementation, the deployment method, the lethality desired, and the type of target to be penetrated.

In this way, the warhead of the subject invention is designed to address multiple potential or actual targets. The warhead may be used in conjunction with a conventional kill vehicle wherein the warhead of the subject invention is deployed first to address multiple potential threats and the kill vehicle is deployed second to target any actual threats revealed when the individual munitions of the warhead strikes the potential threats.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A warhead comprising:

a housing including:

a cylindrical body portion defining a cylindrical cavity, and a dome-shaped end plate attached to one end of the cylindrical body portion defining a dome-shaped cavity;

an explosive charge extending from within the cylindrical body portion cylindrical cavity into the dome-shaped end plate dome-shaped cavity; and a plurality of individual munitions filling both the cylindrical body portion cylindrical cavity and the dome-shaped end plate dome-shaped cavity and about the explosive charge, the explosive charge configured to deploy the munitions upon detonation into a hemispherical dome-shaped pattern.

2. The warhead of claim 1 in which the explosive charge is conical in shape tapering from a larger first end to a smaller second end.

3. The warhead of claim 1 further including a buffer about the explosive charge.

4. The warhead of claim 1 in which said munitions are spherical in shape.

5. The warhead of claim 1 in which said munitions are made from materials including glass, metal, tungsten carbide, a phenolic material, and explosive materials.

6. The warhead of claim 1 in which there are 1,000,000 or more munitions in said cavity.

7. The warhead of claim 1 in which said explosive charge is an insensitive explosive.

8. The warhead of claim 1 in which said housing has a wall thickness of less than 2 mils.

9. The warhead of claim 1 in which said munitions include a munition core and a plurality of particles adhered to an external surface of the munition core designed to release from the munition core upon impact of the munition with a target.

10. The warhead of claim 9 in which said munition core is made of a tungsten carbide composition.

11. The warhead of claim 9 in which said particles are made of glass.

12. The warhead of claim 9 in which said particles are attached to the munition core with an adhesive.

13. The warhead of claim 9 in which said particles are microns in size.

14. A warhead comprising:

a housing defining a cavity;

a conical shaped explosive charge in the housing; and a plurality of individual munitions in the cavity of the housing about the explosive charge, the munitions including a munition core and a plurality of particles attached to an external surface of the munition core designed to release from the munition core upon impact of the munition with a target.

15. A warhead comprising:

a housing including:

a body portion defining a cavity, and a dome-shaped end portion attached thereto defining a dome-shaped cavity;

an explosive charge extending from within the body portion cavity into the dome-shaped end portion dome-shaped cavity; and a plurality of individual munitions filling both the body portion cavity and the dome-shaped end plate dome-shaped cavity and about the explosive charge, the explosive charge configured to deploy the munitions upon detonation into a hemispherical dome-shaped pattern.

16. A warhead comprising:

a housing defining a cavity therein;

an explosive charge in the cavity; and a plurality of individual munitions filling the cavity about the explosive charge, each said munition including a munition core and a plurality of particles adhered to an external surface of the munition core designed to release from the munition core upon impact of the munition with a target.

17. The warhead of claim 16 in which said particles are made of glass.

18. The warhead of claim 16 in which said particles are attached to the munition core with an adhesive.

19. The warhead of claim 16 in which said particles are microns in size.

* * * * *